US006132267A

United States Patent [19]

Campbell

[11] Patent Number: 6,132,267

[45] Date of Patent: Oct. 17, 2000

[54] PROPULSION SYSTEM FOR A BOAT

[76] Inventor: James Stewart Campbell, 3705 Sapona Trail, Pfafftown, N.C. 27040

[21] Appl. No.: 09/270,467

[22] Filed: Mar. 15, 1999

[51] Int. Cl.[7] ..... B60L 11/02

[52] U.S. Cl. ..... 440/6; 14/347; 14/364

[58] Field of Search ..... 440/6, 7, 900, 440/3, 84, 87; 114/343, 347, 364, 144 B, 315; 248/640–643

[56] References Cited

U.S. PATENT DOCUMENTS 4,730,571 3/1988 Hedlund et al. ..... 114/61
4,996,938 3/1991 Cameron et al. ..... 114/315

*Primary Examiner*—Ed Swinehart

[57] ABSTRACT

A propulsion system for a boat utilizing two similar propulsion devices carried in a spaced apart relationship. Each device includes an electric motor, a propeller shaft and a propeller, and the two devices are supported on the extending ends of a yoke spanning the top of the boat to which the system is secured. A cowl substantially encircles each propeller and propeller shaft, and the two propulsion devices are rigidly secured to the yoke so that no rotation of either can take place. A control device regulates the total current passing through the propulsion devices, the direction of rotation of the propulsion devices, and the current passing to each propulsion device to determine the speed and direction of the boat.

17 Claims, 6 Drawing Sheets

PROPULSION SYSTEM FOR A BOAT

BACKGROUND OF THE INVENTION

1. Field of Invention

The present invention relates generally to the propulsion and steering of small boats and more particularly to a system having two similar propulsion means carried in a spaced apart relationship each substantially encircled by a cowl.

2. Description of Prior Art

Fishing boats commonly come equipped with secondary propulsion means that supplement the primary or main propulsion motor. The secondary propulsion means propels the boat more quietly and at a much lower speed than the noisy internal combustion main motor. The secondary propulsion means includes one or more submergible portions which provide propulsive thrusts and mounting portions for mounting each submergible portion to the boat.

Typically the secondary propulsion means submergible portion includes an electric trolling motor and the mounting portion includes the mounting bracket. The trolling motor extends from a vertical shaft which is coupled to the boat by a mounting bracket. The vertical shaft is supported by the mounting bracket in such a way that the rotation of the shaft around its vertical or longitudinal axis is permitted.

A prior art speed and direction control for trolling motors commonly in use consists of a short horizontal steering bar coupled to the vertical shaft in such a manner that the steering bar extends inwardly toward the boat. Steering is accomplished by moving the steering bar from side to side causing the vertical shaft to rotate around its longitudinal axis and turn the trolling motor to change direction of propulsive thrust. The speed control may be either on the motor or on the steering bar.

On fishing boats having pedestal mounted seats in the bow and stern areas, the steering bar is located inconveniently far away from the seats. In addition, the steering bar is most effectively operated by hand. Thus, the inconvenience becomes even greater because the fisherman is using both of his hands to cast and reel as the boat is slowly propelled through the water. To steer the boat while fishing, the fisherman must stop casting and lean over to the steering controls.

Another type of speed and direction control in the prior art allows control from a position that is remote from the trolling motor. The steering control consists of a foot pedal mounted on a fulcrum that enables the pedal to rock back and forth in a seesaw-like fashion, actuating cables to turn the trolling motor. The speed control is a small knob located on the side of the foot pedal which can be rotated.

Common outboard type motors of traditional configuration carry an exposed propeller at the lower end of the depending supporting shaft. This structure positions the propeller in an exposed area where it may be damaged by debris in the surrounding water. Such construction also presents a particular problem in the case of small boats as they commonly operate in shallow waters where operation of a propeller causes excessive splashing.

Thus it can be seen that there is a need for more convenient and positive propulsion system for small boats that frees the operator substantially from steering the boat in a traditional fashion and protects the propeller and other components of the propulsion system. It is to this particular need that the present invention is directed.

SUMMARY OF THE INVENTION

The present invention provides a propulsion system for a small boat. The system includes two propulsion devices having spaced apart electric motors, propeller shafts and propellers powered by an electric battery with each electric motor utilizing a substantially encircling cowl to protect the propeller shaft and propeller. A control device is utilized to regulate total current passing to the propulsion means, the direction of rotation of propulsion means and the current passing to each propulsion means to determine the speed and direction of the boat. The two propulsion means are rigidly positioned so that they cannot be turned in relation to the axis of the boat but can be increased or decreased in speed, reversed or utilized with a combination of these steps to determine the direction and speed of the boat. A yoke spans the width of the boat and its two extending ends each support a propulsion means electric motor, a propeller shaft and a propeller. The control device is conveniently and preferably embodied in a control element with a display screen which incorporates buttons that can be operated by one hand to direct all commands to the boat for power and direction.

In providing this system summarized above, it is a principal object to create a steerable propulsion system for small boats to propel such boats at lower speeds and with substantial maneuverability.

A further object of the present invention is to provide a system that has a pair of laterally spaced apart propulsion means each having an electric motor, a propeller shaft and a propeller.

Another object of the present invention is to provide a system of the type described that is controlled by a single hand operated control unit to vary the power and direction to the paired laterally spaced apart electric motors and control the steering and propulsion of the boat in either a forward or rearward direction. This control unit may be located at the end of a slim electric cable, thus allowing control of boat speed and direction from any convenient location in the boat.

A further object of the present invention is to provide a propulsion system of the type described which utilizes a rechargeable electric battery and embodies cowls substantially encircling the propellers and associated equipment from damage beneath the water. These cowls also allow the propellers to operate just under the surface of the water without splashing water into the boat, even at maximum power. Adjusting the cowl and propeller assemblies to positions just under the water surface allows the boat to operate in very shallow waters.

Yet still a further objective of the present invention is to provide a propulsion system of the type described which may be installed in existing boat structures without material alteration to the existing structure.

Yet still another further object of the present invention is to provide a propulsion system of the type described that is of new and novel design, of rugged and durable nature, of simple and economic manufacture and otherwise well adapted to the uses and purposes for which it is intended.

Thus, there has been outlined the more important features of the invention in order that the detail description that follows may be better understood and in order that the present contribution to the art may be better appreciated. There are, of course, additional features of the invention that will be described hereinafter and which will form the subject matter of the claims appended hereto. In this respect, it is to be understood that the invention is not limited in its application to the details of construction and to the arrangement of the components set forth in the description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of this development. It is important, therefore, that the claims be regarded as including equivalent constructions in so far as they do not depart from the spirit and scope of the invention.

Thus, the enumerated objectives and others identified herein, along with the various features of novelty which characterize the invention, are pointed out with particularity in the claims annexed to and forming a part of this disclosure. For a better understanding of the invention, its operating advantages and the specific results obtained by its use, reference is made to the accompanying drawings forming a part of the specification in which like characters of reference designate like parts throughout the several views.

DESCRIPTION OF THE PREFERRED EMBODIMENT

Figure 1:
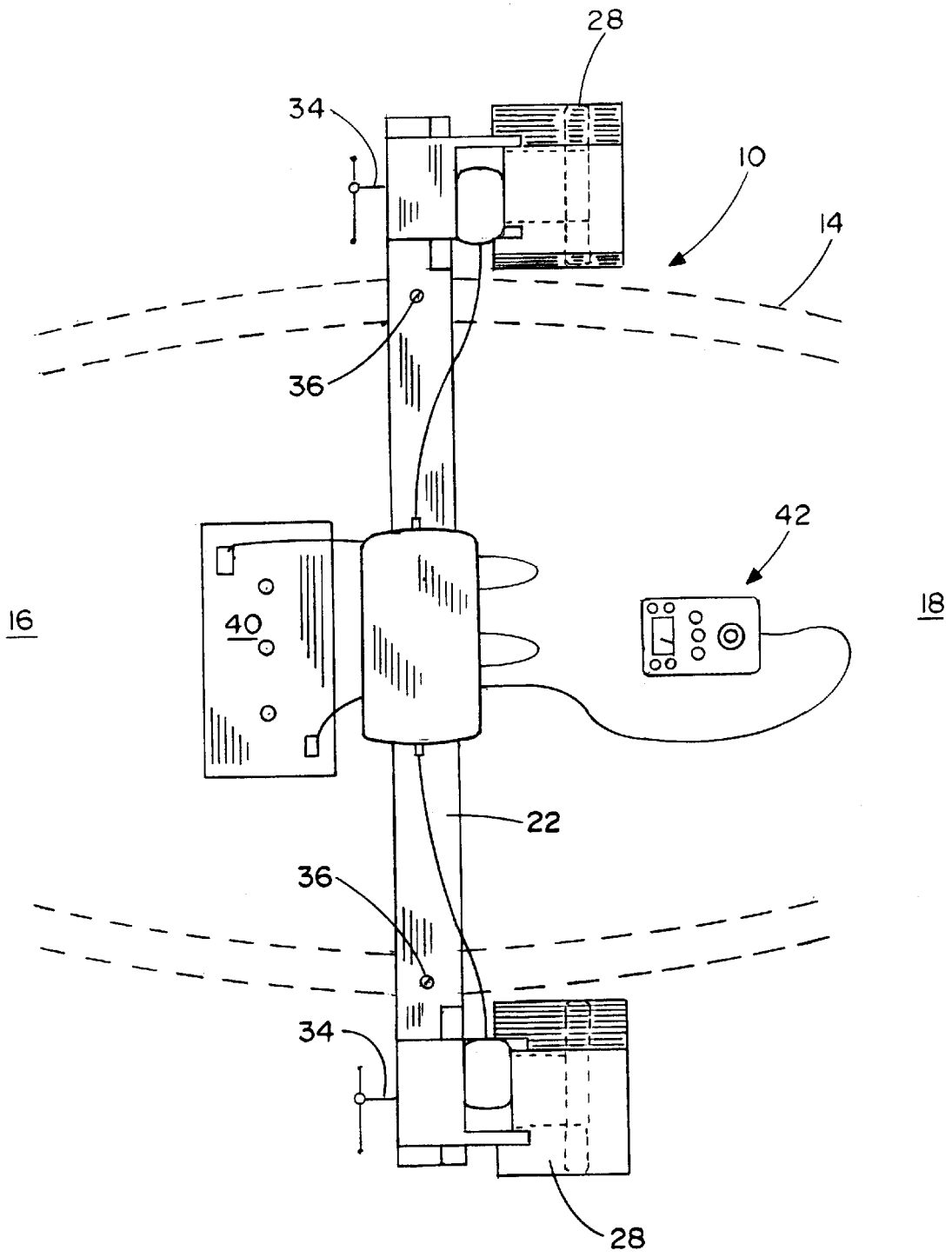
FIG. 1 a top plan partial view of a boat in broken lines utilizing the propulsion system of the present invention in solid lines.
Figure 2:
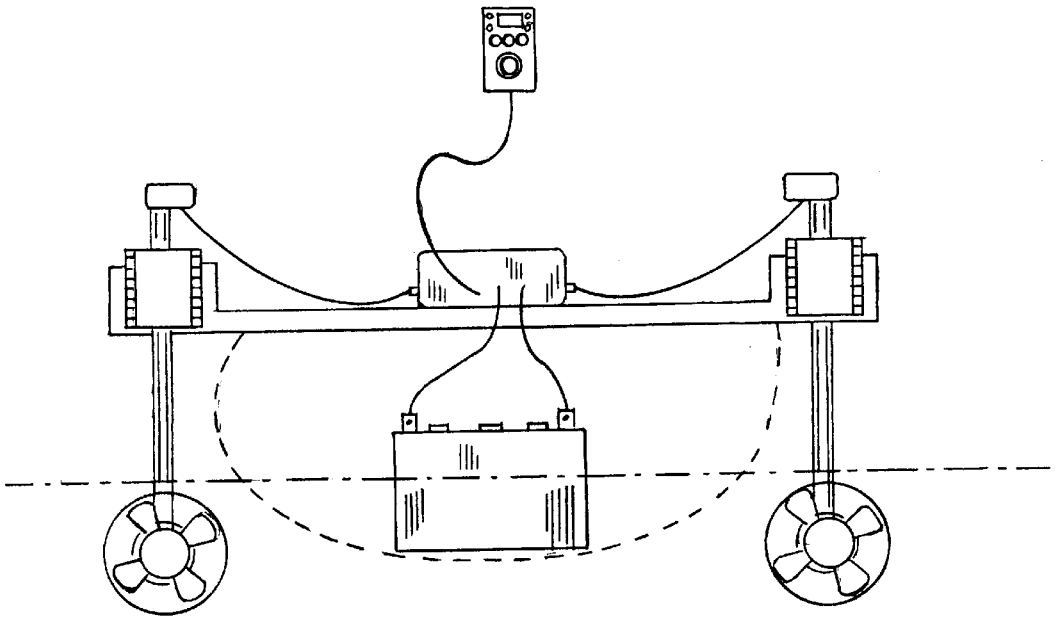
FIG. 2 is an end elevational schematic view of the propulsion system comprising the invention affixed to a boat the outline of which along with which the operational waterline is shown in broken lines.

A small boat such as a canoe shown generally as 10 is illustrated in FIG. 1 of the drawings. Boat 10 has a bottom 12 an upstaking side 14 (FIGS. 2 and 3) which join in their forward and rearward portions to form bow and stern 16, 18.

A pair of propulsion means shown generally as 20 are mounted in a spaced apart relationship (FIG. 2) wherein a yoke 22 spans the top of the boat so that it has extending ends 24 overhanging sides 14 of boat 10 in the manner shown. Yoke 22 is fixedly secured to the structure of the boat and is adapted to receive a propulsion system 20 on each extending end 24.

Each propulsion system 20 includes an electric motor 26, a propeller shaft 28, and a propeller 30 encircled by a cowl 38. Depending support rods 32 are secured to yoke 22 in a rigid, non movable relationship so that motor 26, propeller shaft 28, propeller 30 and cowl 38 remain in a fixed relationship with respect to the boat during operation.

Yoke extending ends 24 each have an upstanding flange 25 providing a convenient surface on which to mount the connecting clamp 34 which holds depending rod 32, motor 26, propeller shaft 28, propeller 30 and cowl 38 in a fixed position. Yoke 22 can be removed from boat 10 by loosening the connecting screws 36 shown in FIGS. 1, 2 and 3.

Figure 3:
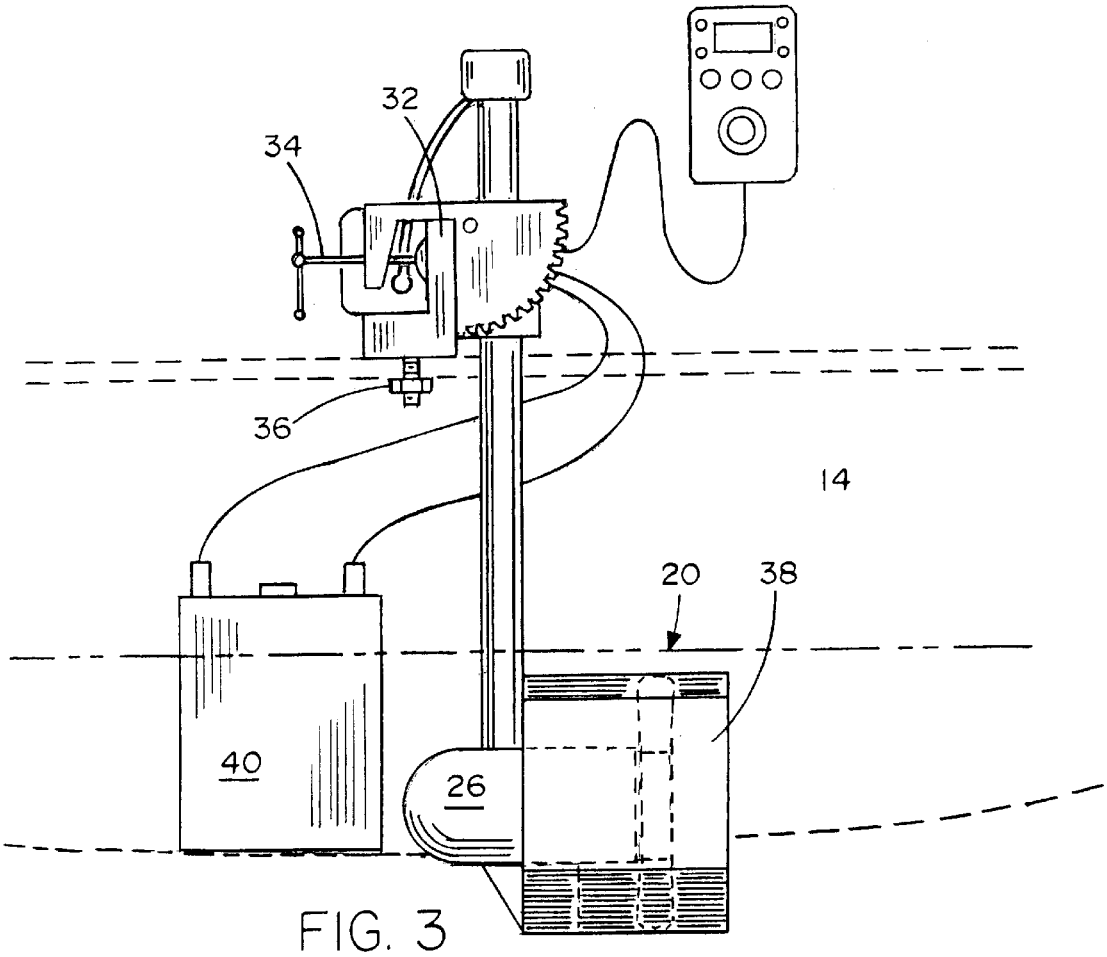
FIG. 3 is a side elevational, schematic and partial view of the propulsion system comprising the present invention showing in detail the mounting of the motors to the yoke spanning the top of the boat and the positioning of the control device and power supply.
Figure 4:
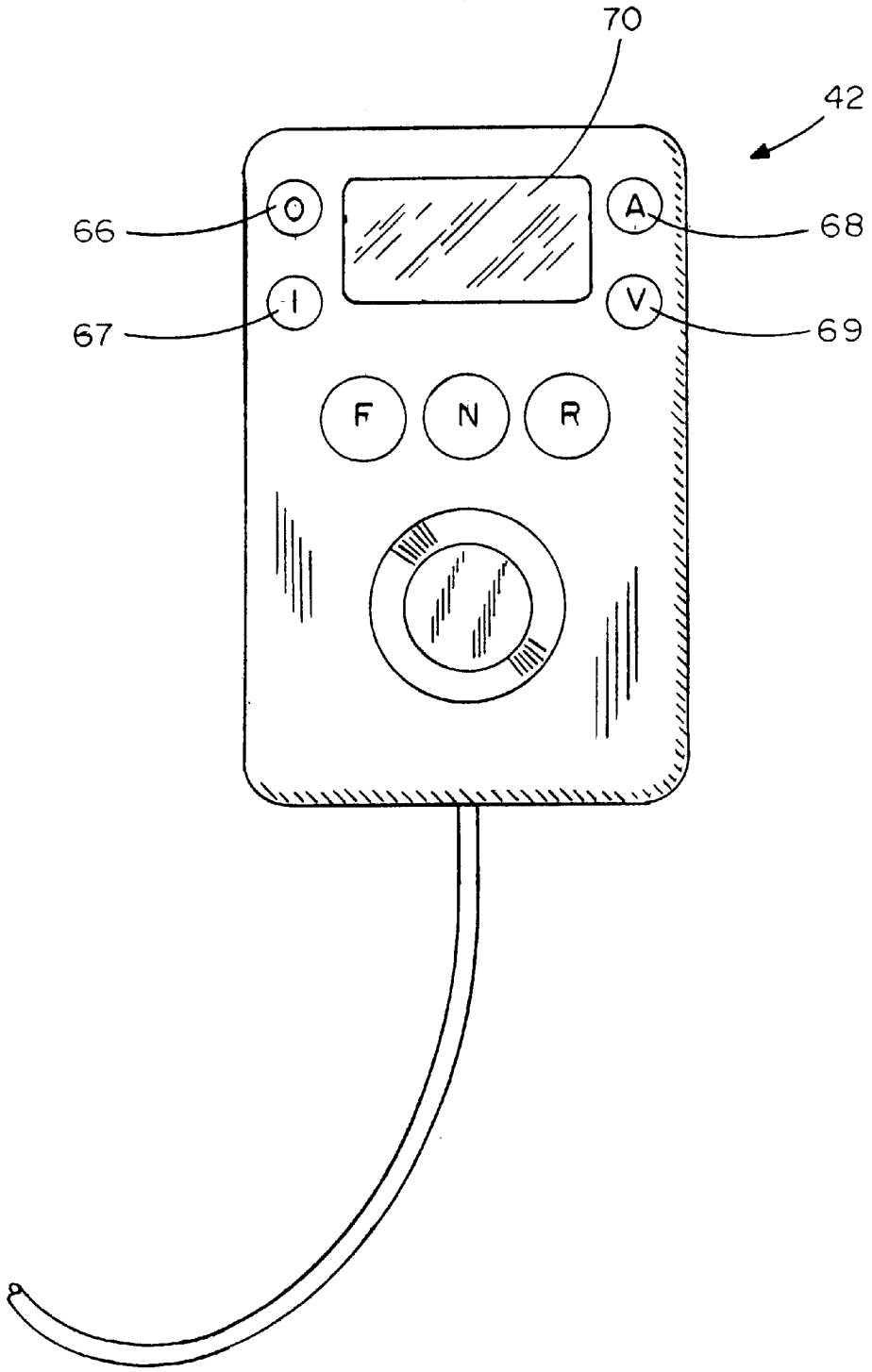
FIG. 4 is an enlarged and isolated view of the control device utilizing the preferred embodiment of the present invention for one hand use so that the motors can be simultaneously controlled by the operator in a convenient manner and location.

Cowl 38 substantially encircles motor 26, propeller shaft 28, and propeller 30 in the manner best shown in FIG. 3 so that these components are protected from damage should the boat engage foreign objects in shallow water and so that propeller splash is prevented when running the propellers just under the water level 23. Cowls 38 also provide a power passageway so that the force of a thrust from the motor driven propeller 30 is accentuated through the channel formed thereby.

Power to the propulsion system of the present invention is provided preferably by an electric battery 40 which can be removed for recharging or which can communicate in a parallel electrical arrangement with an on-board generator or other charging system (not shown).

A handheld controller unit shown generally as 42 has been developed to enable the operator to power and steer the boat by the use of one hand. Basic motor thrust controls are push buttons labeled F, N, R standing for forward, neutral and reverse while directional variation is controlled by the additional controls labeled 0, I, A, and V perform the following functions: O 66 turns the controller OFF, I 67 turns the controller ON, A 68 makes the total current from battery 40 appear on the meter display 70. V 69 makes the voltage of battery 40 appear on the meter display 70.

Figure 5:
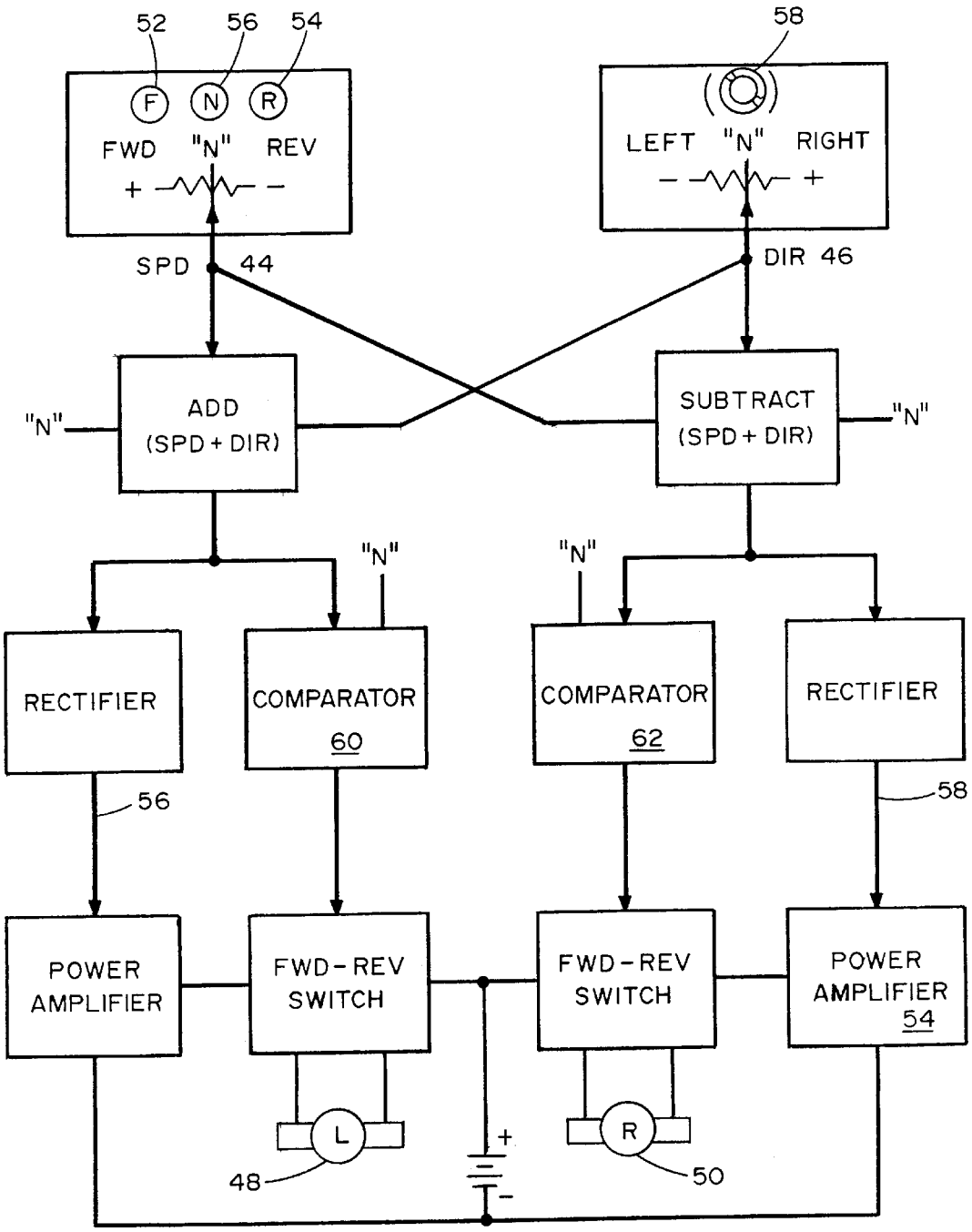
FIG. 5 is a block circuit diagram of the present invention.

Device 42 is controlled by circuitry which has been broken down into a block diagram shown for convenience in FIG. 5. Electronic control of vessel speed and direction is performed by two inputs, speed SPD 44 and direction DIR 46 which, through analog and/or digital computational means, adjust the left and right motors 48, 50 of boat 10 to direct it on the desired course heading and speed in the following manner.

The quantity SPD 44 is adjustable on both sides of a neutral value, "IN". "N" is defined for SPD 44 as no net forward or reverse thrust from motors 48, 50. Values of SPD 44 greater compared to "N" drive the craft forward, and values less than compared to "N" drive the craft in the reverse direction. SPD 44 may be generated through the action of three push buttons, F 52 driving the craft faster in the forward direction if activated, R 54 driving the craft faster in the reverse direction if activated, and N 56 setting the net thrust of the motors to zero (no net thrust) if activated.

Quantity DIR 46 is also adjustable on both sides of the same neutral value, "N". "N" is defined for DIR 46 as no net left or right torque generated by motors 48, 50. Values of DIR 46 greater compared to "N" turn the boat bow right, and values less than compared to "N" turn the boat bow left. DIR 46 may be generated by a single knob control 58. Turning knob 58 counterclockwise causes the boat bow to turn left, and turning it clockwise causes the boat bow to turn right. This turning motion can be accomplished with no net forward or reverse boat speed. By causing the motors 48, 50 to have equal thrusts but opposite directions.

These two signals, SPD 44 and DIR 46, are processed by a computer and power circuitry to adjust the power to motors 48, 50 as follows: the relative values of SPD 44, and DIR 46, in relation to "N" are added in one portion of the computer (SPD 44+DIR 46), and subtracted in a separate portion of the computer (SPD 44−DIR 46). The sum (SPD+DIR) is compared to "N" to determine the direction of the left motor 48, with the motor pushing the boat forward if the sum is greater than "N", and reverse if the sum is less than "N". The magnitude of the sum (SPD 44+DIR 46) relative to "N" is also rectified and amplified by the left power amplifier 52 to adjust the speed of the left motor 48. The difference (SPD 44–DIR 46) is compared to "N" to determine the direction of the right motor 50, with the motor pushing the boat forward if this difference if greater than "N", and in reverse if the difference is less than "N". The magnitude of this difference compared to "N" is rectified and amplified by the right power amplifier 54 to adjust the right motor speed.

Figure 6:
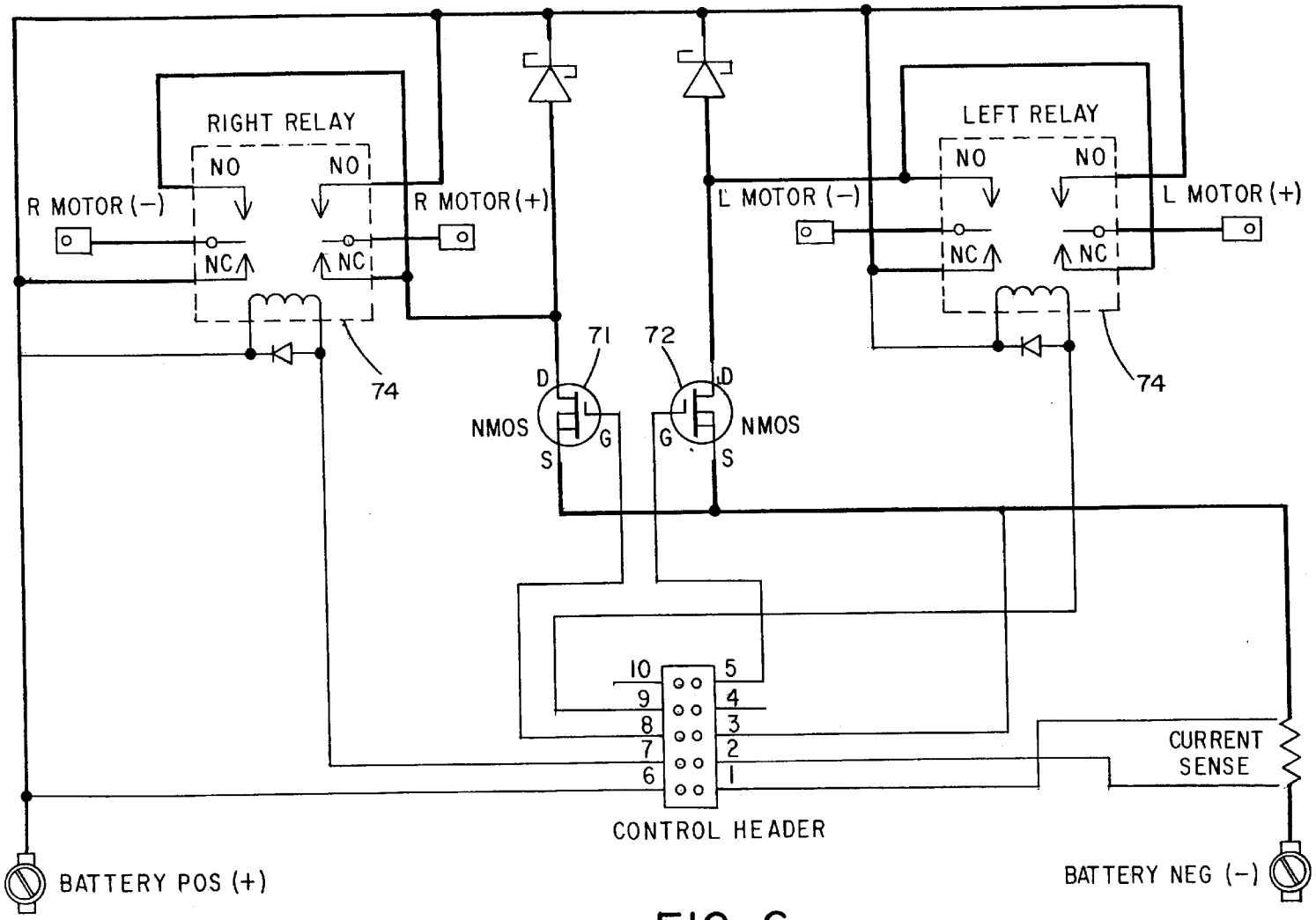
FIG. 6 is a detailed circuit diagram of a power module utilizing reversing relays.
Figure 7:
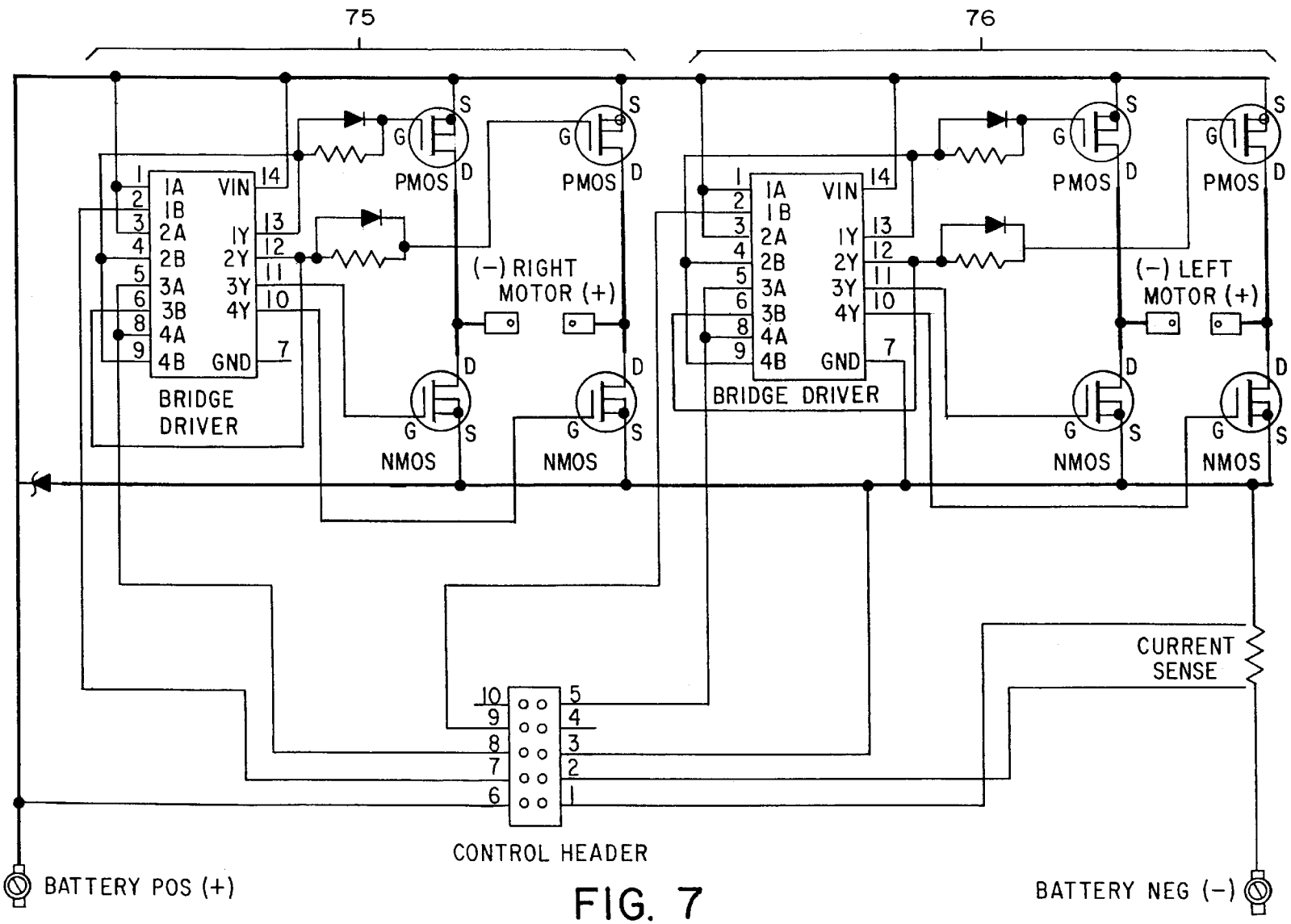
FIG. 7 is a detailed circuit diagram of a power module utilizing "H" bridge motor drives.

The low-power control signals from the controller 42 are passed to the high-power circuitry in the power module 21 which is connected via heavy gauge conductors to battery 40. The power amplification to each motor may be accomplished by the circuit of FIG. 6 which uses the magnitude of that motor's rectifier output 55, 58 to adjust a pulse-width drive to a low-resistance MOSFET transistor 71, 72. Motor reversal may be done by using that motor's associated comparator circuit 60 or 62 to drive a DPDT reversing relay 73, 74. Alternatively, the rectifier outputs can adjust the pulse-width drive to standard H-bridge MOSFET power control circuits 75, 76, with the comparators driving the reversing portions of the corresponding H-bridge circuit as shown in FIG. 7.

In this manner, the controller, acting through the motors, can propel the craft in both forward and reverse directions, and can turn it to left or right whether it is proceeding in forward or reverse, or while it is stopped.

A second possible embodiment for the hand controller 42 has the SPD 44 and DIR 46 signals adjustable via a single joystick lever means, where SPD44 is adjustable from full forward speed to full reverse speed by manipulating the lever in one plane, and DIR 46 is adjustable from full left turn to full right turn by manipulating the lever at right angles to the plane of SPD 44.

Thus through the use of the propulsion system set forth herein, a high degree of maneuverability may be obtained by boat serviced by such when the boat is moving in any direction.

It will be apparent to those skilled in the art that variations may be made in the components and parts of the present invention without departing from the spirit and scope thereof. While such components and parts in accordance with the invention has been specifically exemplified in the foregoing, it will be understood that the example is for the purpose of illustration and that modifications are contemplated. The invention is defined by the following claims with equivalents to the claims to be included therein.

What is claimed is:

1. A propulsion system for a boat comprising: two propulsion means carried in a spaced apart relationship by the boat; a cowl associated with each propulsion means; power supply means supplying electrical energy to each propulsion means; and control means adjustable to regulate total current passing to the propulsion means from the power supply means, the direction of rotation of the propulsion means, and the current passing to each propulsion means to determine the speed and direction of the boat, each of the propulsion means including an electric motor, a propeller shaft and a propeller for rotation, a yoked adapted to span the width of the boat to extending ends, each yoke end carrying one of said propulsion means.

2. The system as claimed in claim 1 wherein the yoke is adapted to be releasably secured to the boat.

3. The system as claimed in claim 1 wherein the propeller shafts and the propellers are fixedly secured to the yoke in a non-turning relationship when operating.

4. The system as claimed in claim 1 wherein the cowl associated with each propulsion means substantially encircles the propeller shaft and the propeller.

5. The system as claimed in claim 1 wherein the power supply means is a rechargeable electric battery.

6. The system as claimed in claim 1 wherein the control means includes a control rod movable in a first direction to vary the amount of current passing to one motor relative to the current passing to the other motor and movable in a perpendicular direction to regulate the total amount of current passing through the control means to both motors.

7. The system as claimed in claim 2 wherein the propeller shafts and propellers are fixedly secured to the yoke in a non-turning relationship.

8. The system as claimed in claim 2 wherein the cowl associated with each propulsion means substantially encircles the propeller shaft and the propeller.

9. The system as claimed in claim 2 wherein the power supply means is a rechargeable electric battery.

10. The system as claimed in claim 2 wherein the control means includes a control rod movable in a first direction to vary the amount of current passing to one motor relative to the current passing to the other motor and movable in a second perpendicular direction to regulate the total amount of current passing through the control means to both motors.

11. The system as claimed in claim 7 wherein the cowl associated with each propulsion means substantially encircles the electric motor, the propeller shaft and the propeller.

12. The system as claimed in claim 11 wherein the power supply means is a rechargeable electric battery.

13. The system as claim in claim 12 wherein the control means includes a control rod movable in a first direction to vary the amount of current passing to one motor relative to the current passing to the other motor and movable in a second perpendicular direction to regulate the total amount of current passing through the control means to both motors.

14. The system as claimed in claim 1 wherein the control means is a portable, handheld device which communicates to the power supply means by a cable.

15. The system as claimed in claim 13 wherein the control means further includes a turning knob control functioning to develop and direct the steering torque generated by the difference in the thrust of the two propulsion means.

16. A propulsion system for a canoe comprising: two propulsion means carried in a spaced apart relationship by the canoe; a cowl associated with each propulsion means; power supply means supplying electrical energy to each propulsion means; and control means movable to regulate total current passing to the propulsion means, the direction of rotation of the propulsion means, and the current passing to each propulsion means to determine the speed and direction of the canoe, each propulsion means including electric motor, a propeller shaft and a propeller for rotation, a yoke adapted to span the width of the canoe with two extending ends, each yoke end carrying one of said propulsion means and releasably supporting a propulsion means support shaft fixedly connected thereto and extending downwardly beneath the water surface to support the propulsion means propeller shaft and propeller, the yoke adapted to being releasably secured thereto to the canoe.

17. The system as claimed in claim 16 wherein the control means is a portable, handheld device which communicates to the power supply means by electromagnetic field energy.

* * * * *